United States Patent [19]

Imai

[11] 4,322,083

[45] Mar. 30, 1982

[54] GOLF CLUB HEAD

[75] Inventor: Sigeru Imai, Ito, Japan

[73] Assignee: Shintomi Golf Co., Ltd., Tokyo, Japan

[21] Appl. No.: 83,329

[22] Filed: Oct. 10, 1979

[30] Foreign Application Priority Data

Oct. 26, 1978 [JP] Japan ..... 53-147366

[51] Int. Cl.[3] ..... A63B 53/04

[52] U.S. Cl. ..... 273/167 F; 273/172

[58] Field of Search ..... 273/77 R, 77 A, 167–175

[56] References Cited

U.S. PATENT DOCUMENTS

| | | | |
|---|---|---|---|
| 868,687 | 10/1907 | Myles | 273/167 F |
| 1,257,471 | 2/1918 | Fitzjohn et al. | 273/167 F X |
| 1,269,745 | 6/1918 | Robertson | 273/172 |
| 1,289,192 | 12/1918 | Klin | 273/172 X |
| 1,322,182 | 11/1919 | Duncan | 273/172 |
| 1,433,744 | 10/1922 | Rhind | 273/172 |
| 1,497,578 | 6/1924 | Mothersele | 273/172 |
| 1,555,425 | 9/1925 | McKenzie | 273/169 |
| 1,720,867 | 7/1929 | Webster et al. | 273/169 |
| 2,254,528 | 9/1941 | Hoare | 273/167 F X |
| 2,447,967 | 8/1948 | Stone | 273/169 X |
| 2,784,969 | 3/1957 | Brandon | 273/77 A |
| 3,037,770 | 6/1962 | Palmer | 273/167 G X |
| 3,655,188 | 4/1972 | Solheim | 273/77 A |
| 3,751,035 | 8/1973 | Lockwood | 273/77 A |
| 3,762,717 | 10/1973 | Johnston | 273/167 F |
| 3,847,399 | 11/1974 | Raymont | 273/167 F |
| 3,979,122 | 9/1976 | Belmont | 273/171 |
| 4,027,885 | 6/1977 | Rogers | 273/167 F X |
| 4,063,737 | 12/1977 | Tom et al. | 273/174 |
| 4,128,242 | 12/1978 | Elkins | 273/77 A |
| 4,147,349 | 4/1979 | Jeghers | 273/77 A |

FOREIGN PATENT DOCUMENTS

| | | | |
|---|---|---|---|
| 5121 | of 1905 | United Kingdom | 273/169 |
| 13939 | of 1906 | United Kingdom | 273/169 |
| 7365 | of 1912 | United Kingdom | 273/167 F |
| 385660 | 1/1933 | United Kingdom | 273/77 A |
| 414516 | 8/1934 | United Kingdom | 273/169 |

*Primary Examiner*—Richard J. Apley

*Attorney, Agent, or Firm*—Schwartz, Jeffery, Schwaab, Mack, Blumenthal & Koch

[57] ABSTRACT

A golf club head in which the center of gravity of the mass thereof is located on a line perpendicular to a club face of the head and passing through a meet point prelocated on the club face.

4 Claims, 16 Drawing Figures

GOLF CLUB HEAD

This invention relates to an improvement of wooden and iron golf club heads.

Figure 1:
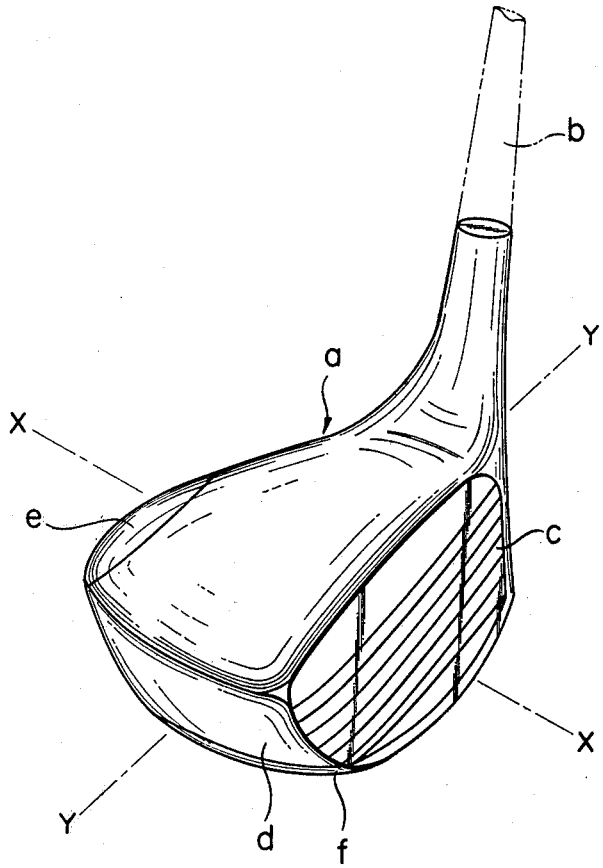
FIG. 1 PRIOR ART

An ordinary club head, e.g. a wooden club head a as shown in FIG. 1, is manufactured as one component independent of a shaft b represented by the chain line. If the cross axis passing through a substantially flat club face c on the front side of the head a is X—X and the axis perpendicular to the axis X—X is Y—Y, a back metal e is fixed integrally to a wooden body d on the opposite side thereof to the club face c as taken along the axis X—X, and a sole metal f is fixed integrally on the sole or bottom side of the sole metal f, the body d and the metals e and f constituting the club head a.

Figure 2:
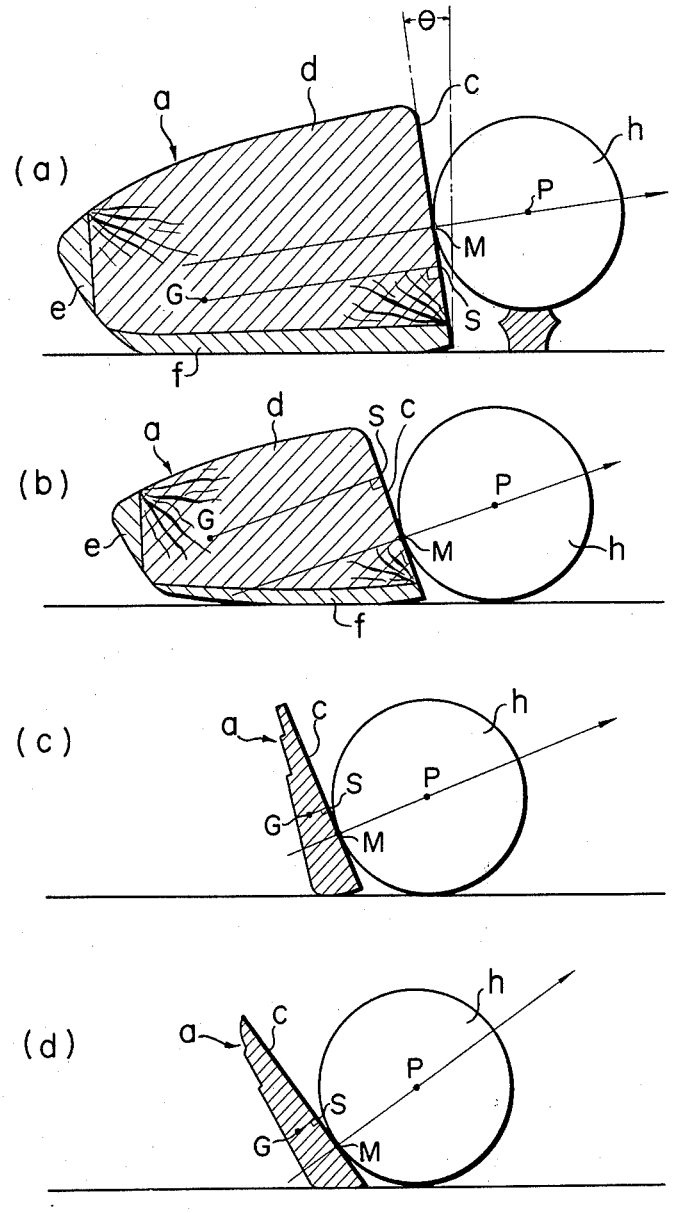
FIG. 2 PRIOR ART

Referring now to the drawings of FIG. 2 showing various types of the club head a in cross sections as taken along the axis X—X, there will be described problems or defects of the club head of the conventional construction.

Here it is supposed, for the club head a of any of FIGS. 2(*a*) to 2(*d*), that the center of gravity of the head is G, the cross point of the perpendicular to the club face c passing through the point G and the face c, which is generally called the sweet spot, is S, the point where a golf ball h is brought in contact with the club face c, which is generally called the meet point, is M, the center of the golf ball h is P, and the angle formed between the club face c and a vertical line, which is generally called the loft angle, is $\theta$. FIGS. 2(*a*) and 2(*b*) show wooden club heads, while FIGS. 2(*c*) and 2(*d*) show iron club heads. In any of these heads, the meet point M and the sweet spot S do not overlap each other. The meet point M generally is a base point on the club face c where the golf ball h is touched by the face c, varying with the type of club head. Also, the meet point M shifts its position with the loft angle $\theta$; the wider the loft angle $\theta$, the lower the position of the meet point M on the face c is, as may be seen from FIG. 2. In the driver head of FIG. 2(*a*), the meet point M where the teed golf ball h is touched by the face c is located substantially in the middle of the face c.

In the driver head of FIG. 2(*a*), the center of gravity G of the head is located below the line connecting the center P of the ball h and the meet point M. In the heads of the fairway wood of FIG. 2(*b*) and the long and short irons of FIGS. 2(*c*) and 2(*d*), on the other hand, the center of gravity G is located above the line connecting the center P and the meet point M.

Figure 4:
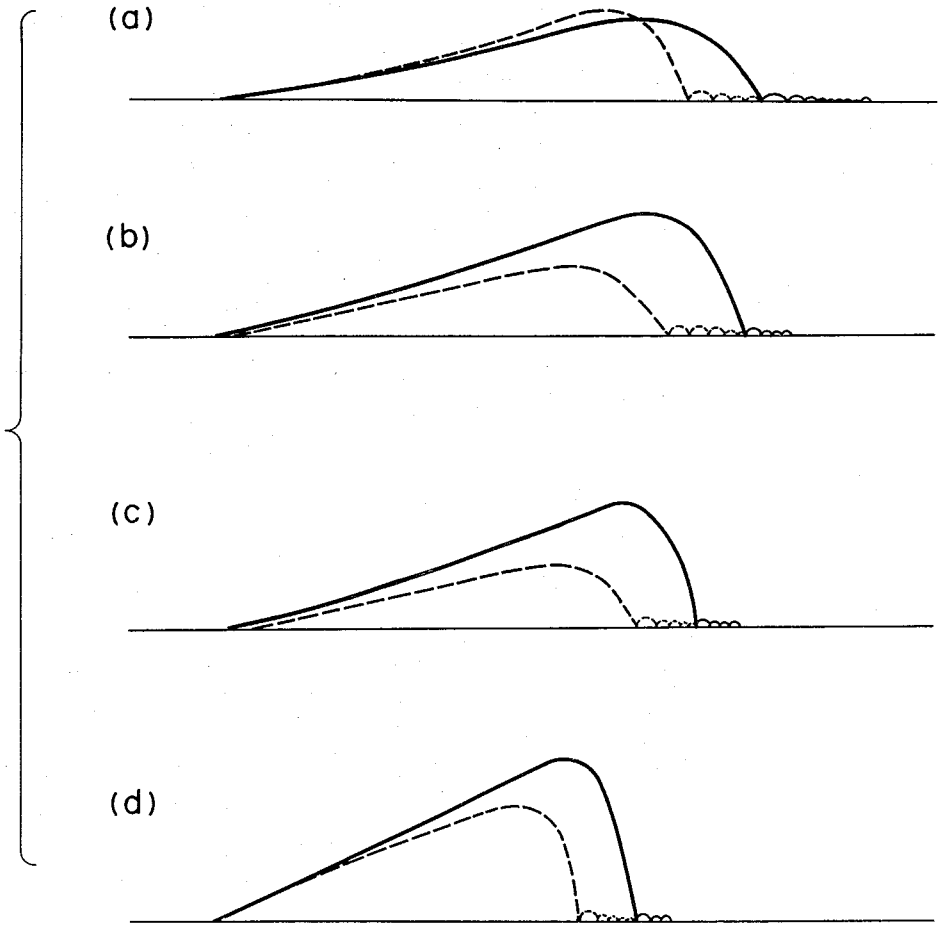

When a tee-shot is made by using the driver of FIG. 2(*a*), the ball generates a trajectory as represented by the broken line of FIG. 4(*a*), exhibiting limited maximum flight distance and short run after landing. This is attributable to a situation that the center of gravity G of the head a is located below the line PM, in other words, the sweet spot S is below the meet point M.

On the other hand, when balls are hit by the respective heads of FIGS. 2(*b*), 2(*c*) and 2(*d*), resultant trajectories of the balls generally involve losses in flight distance, as represented by the broken lines in FIGS. 4(*b*), 4(*c*) and 4(*d*). Especially in the case of the head of the short iron (FIG. 2(*d*)), there is a problem of unsatisfactory back spin. This is so because the center of gravity G of each such head is located above the line PM, that is, the sweet spot S is above the meet point M.

The object of this invention is to provide kinetically outstanding club heads capable of transmitting the maximum of energy generated at the club heads to a golf ball so that long ball flight distance and prolonged run after landing may be secured in the case of a driver head, and that long flight distance and positive back spin may be obtained in the case of a short iron head.

In order to attain the above object, a club head according to this invention basically is so designed that the center of gravity of the head is located, as taken along a cross section of the head, on a line substantially perpendicular to a club face and passing through a just meet point which is prelocated according to the loft angle of the head. In other words, the meet point and the sweet spot are in perfect alignment, for any types of the head.

For that purpose, the location of the center of gravity of the head is adjusted by elaborating the size and shape of back and sole metals for wooden club heads or by forming a hollow on the opposite side to the club face for iron heads.

Figure 3:
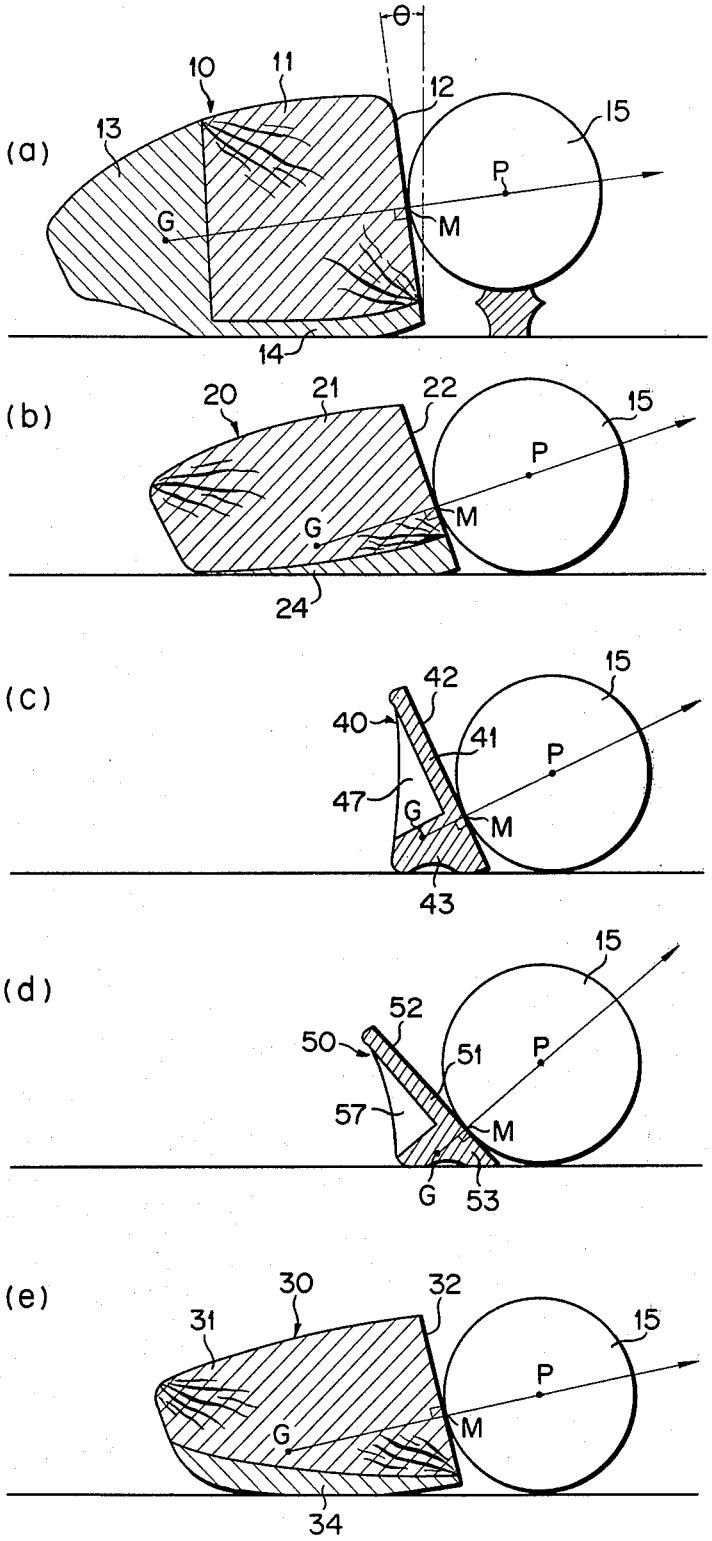
Figure 5:
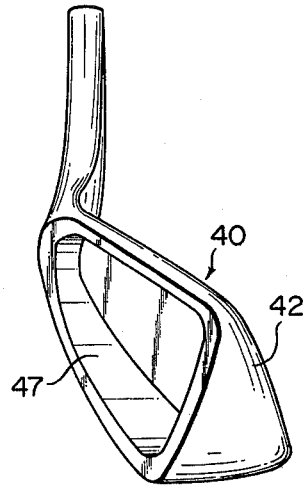
Figure 6:
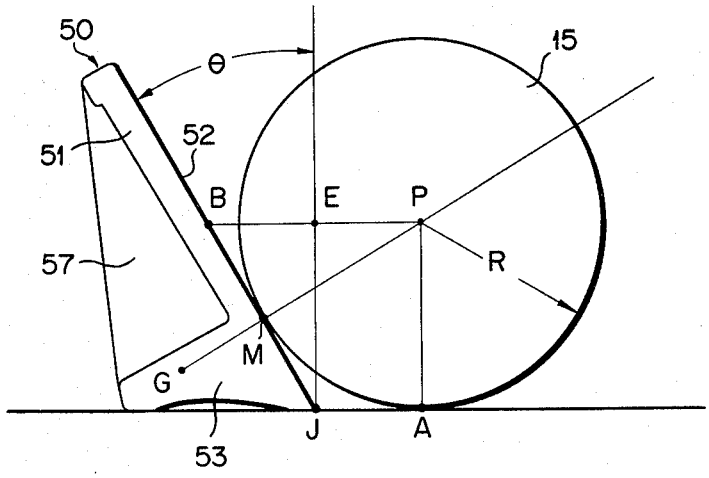

This invention can be more fully understood from the following detailed description when taken in conjunction with the accompanying drawings, in which:

FIG. 1 is a perspective view of a prior art wooden club head;

FIGS. 2(*a*) to 2(*d*) are cross-sectional views of various prior art club heads for illustrating their problems;

FIGS. 3(*a*) to 3(*e*) are cross-sectional views of various club heads according to this invention, resembling the drawings of FIG. 2;

FIGS. 4(*a*) to 4(*d*) show trajectories and runs of golf balls, for the comparison of the flight performances of the several prior art club heads of FIGS. 2(*a*) to 2(*d*) and their respective counterparts shown in FIGS. 3(*a*) to 3(*d*), broken and full lines representing the trajectories and runs produced by the prior art club heads and the club heads of the invention, respectively;

FIG. 5 is a perspective view of an iron club head according to the invention; and FIG. 6 is a cross-sectional view of the iron club head of the invention taken as an example for illustrating the setting of the center of gravity of the head, meet point, etc.

Now there will be described the club heads according to this invention with reference to the accompanying drawings, especially FIGS. 3, 5 and 6.

Referring now to FIG. 3(*a*), there is shown a club head 10 which is the head of a No. 1 wood or driver for tee-shot. As may be seen from the cross-section of FIG. 3(*a*), the head 10 is composed of a wooden body section 11, a substantially flat club face 12 with the loft angle of $\theta$ on the front side, a back metal 13 fixed integrally to the body section 11 on the rear side thereof opposite to the club face 12, and a sole metal piece 14 fixed integrally to the bottom or sole portion of the body.

The previously designed just meet point M on the club face 12 of the driver head 10 is so set as to coincide with the point actually contacted by a teed standard golf ball 15 as shown in FIG. 3(*a*), lying substantially on the midpoint of the club face 12.

Further, according to this invention, the center of gravity G of the head 10 is located on an extension of the line connecting the center P of the ball and the meet point M. Unlike the prior art head of FIG. 2(*a*), the proportion of the cross-sectional area of the back metal 13 to that of the wooden body section 11 is increased to approximately 60% or at least 50% in order to effect the above-mentioned location. As for the sole metal 14, it is somewhat narrowed as compared with the case of the conventional one.

Thus, the center of gravity G of the head can be located on the extension of the line MP by widening the region of the back metal 13 to elevate the center of gravity G.

Accordingly, the line GM is made substantially perpendicular to the club face 12.

If the golf ball 15 is hit exactly on the just meet point M by the driver of the aforementioned construction, the trajectory generated by the ball will be as represented by the full line of FIG. 4(*a*), providing longer flight distance and prolonged run as compared with the trajectory in broken line produced by the prior art driver. This effect can be obtained because the center of gravity G of the head, the meet point M and the center P of the ball are in a straight line, so that the energy generated at the head 10 may be transmitted most effectively to the ball.

A club head 20 of FIG. 3(*b*) is the head of a No. 4 wood or fairway wood. As may be seen from the cross section of FIG. 3(*b*), the head 20 is composed of a wooden body section 21 having a club face 22 on the front side, and a sole metal 24 fixed integrally to the bottom or sole portion of the body section. The just meet point M on the club face 22 is in alignment with the contact point between the unteed standard ball 15 and the club face 22. Since the loft angle of the head 20 is wider than that of the driver head (FIG. 3(*a*)), the just meet point M is lowered a little.

Also in this club head 20, the center of gravity G of the head is located on an extension of the line connecting the center P of the ball 15 and the meet point M.

In order to attain this, the sole metal 24 is thickened gradually from the rear side to the front side, that is, toward the club face 22.

In a club head 30 of a No. 2 or 3 wood or fairway wood as shown in FIG. 3(*e*), on the other hand, a sole metal 34 at the bottom of a body section 31 is thickened gradually from the front side to the rear side in order to locate the center of gravity G of the head 30 on an extension of the line connecting the center P of the ball 15 and the meet point M on the club face 32.

If the golf ball 15 is hit on the meet point M by the club head 20 as shown in FIG. 3(*b*), the trajectory generated by the ball will be as represented by the full line of FIG. 4(*b*), exhibiting longer flight distance and reduced run after landing due to effective back spin, which facilitates stop at the target position, as compared with the trajectory in broken line produced by the head of the prior art construction.

The same effect of the head 20 of FIG. 3(*b*) may be obtained from the head 30 of FIG. 3(*e*).

To reiterate in somewhat different terms, it will be apparent that the sole metal sections of the club heads of FIGS. 3(*b*) and 3(*e*) have certain widths along their lengths and that these widths are a function of the loft angle. As will be seen from the foregoing discussion of the No. 4 and No. 2 or 3 fairway woods of FIGS. 3(*b*) and 3(*e*), respectively, this relationship is such that the larger the loft angle, the greater are the widths of the sole metal sections near the club face in comparison with those remote from the club face. At one certain loft angle, i.e., that of the No. 4 fairway wood of FIG. 3(*b*), it will be seen that the width of the sole metal section has a gradual, converging taper in a direction toward the club face. On the other hand, at another particular loft angle, i.e., that of the No. 2 or 3 fairway wood of FIG. 3(*e*), the width of the sole metal section has a gradual, converging taper in a direction away from the club face. It will be apparent from the drawing that these sole metal sections cover substantially the entire sole portion of the body sections of these woods.

A club head 40 of FIG. 3(*c*) is the head of a long or middle iron, while a club head 50 of FIG. 3(*d*) is the head of a short iron. The short iron head 50 has a wider loft angle than that of the long or middle iron head 40, so that the meet point M of the former, on a club face 52, is located below that of the latter.

Also in these iron club heads 40 and 50, the center of gravity G of each head is located on an extension of the line connecting the center P of the ball 15 and the meet point M. In order to achieve such location of the center of gravity, these iron heads 40 and 50 are provided respectively with hollows 47 and 57 on the opposite side to the club faces 42 and 52 or on the rear side. The shape of these hollows 47 and 57 will easily be seen from the perspective view of FIG. 5 showing the hollow 47 in the iron head 40 of FIG. 3(*c*).

By the formation of the hollow 47 or 57, the center of gravity G of the head can be lowered fully as compared with the case of the iron club heads of FIGS. 2(*c*) and 2(*d*). As shown in FIGS. 3(*c*) and 3(*d*), the iron heads 40 and 50 of this invention are composed respectively of narrow sections 41 and 51 of substantially uniform thickness extending along the club faces 42 and 52, as taken along cross sections of the heads, and enlarged sections 43 and 53 connected with the sections 41 and 51 and defining the bottom portions of the heads. The cross section of each head is substantially L-shaped. As regards the iron heads, such shape is characteristic of this invention.

FIGS. 4(*c*) and 4(*d*) show in full lines trajectories which may be obtained when the ball 15 is hit on the meet point M by the iron heads 40 and 50 of FIGS. 3(*c*) and 3(*d*), respectively. As may be seen from these drawings for the comparison with the trajectories in broken lines generated by the prior art iron heads, the iron heads of this invention may provide longer flight distance and reduced run due to the effect of back spin which facilitates approach to the target position.

The above-mentioned advantages of this invention are emphasized especially in the short iron 50, in which the center of gravity G could be lowered substantially as compared with the case of the prior art counterpart.

Referring now to FIG. 6, the position of the just meet point M of the short iron club head 50 of FIG. 3(*d*) is theoretically determined as will now be explained. In this regard, it will be apparent from the drawing that the club head is in the address position for the purpose of making this determination.

If the point where the golf ball 15 touches the ground is A, the sole edge of the head 50 is J, the intersection of the line extended from the center P of the ball 15 in parallel with the line AJ and the club face 52 is B, the intersection of a perpendicular passing through J and the line PB is E, the radius of the ball 15 is R, and that the loft angle is $\theta$, then we obtain $$\angle BPM = \angle BJE = \theta$$

$$\because \left( \begin{array}{l} \text{For } \Delta BPM \equiv \Delta BJE \\ \quad \angle PBM = \angle JBE \\ \quad \angle PMB = \angle JEB = 90^\circ \end{array} \right)$$

$$PM = PA = EJ = R$$

-continued $$JB = R \sec\theta$$

$$BM = R \sec\theta \cdot \sin\theta$$

$$JM = JB - BM = R \sec\theta - R \sec\theta \cdot \sin\theta$$

$$JM = R \sec\theta\,(1 - \sin\theta)$$

Thus, the length of the line JM is settled by determining the angle $\theta$, so that the position of the just meet point M is decided. After the location of M, it is necessary only that the center of gravity G of the head 50 be fixed on a line perpendicular to the club face 52 through M. The length of the line MG may be determined suitably. However, the center of gravity G should preferably be far apart from the club face. The reason is that the longer the distance between the center of gravity G and the club face, the less the deviation of the trajectory of a golf ball hit off the meet point may be, to ensure stable shot.

Since the club heads according to this invention, especially the iron club heads 40 and 50, may be so designed, in view of the aforementioned conditions, that the center of gravity G is located in the enlarged sections 43 and 53 projected long from the club face to the rear side, so that the distance MG can be set long. Unlike the heads of this invention, the prior art iron club heads, as shown in FIGS. 2(*c*) and 2(*d*), have no such backward projections, so that the center of gravity G could not help being close to the club face.

Thus, with the club heads according to this invention, the energy generated at the head is transmitted efficiently to the ball, so that the ball flight distance can be lengthened, the run after landing may be improved as required according to the type of club, and further stable shot may be secured.

What is claimed is:

1. A golf club comprising:

a club head;

a substantially flat club face on one side of said head, said club face being adapted to strike a golf ball; said club face having upper and lower edges;

said club face being disposed at an angle with respect vertical when said club face is in an address position with respect to a golf ball; said angle being a loft angle ($\theta$) which determines the amount of loft imparted a golf ball when it is struck by the club face; said loft angle ($\theta$) being greater than zero;

said club face having a point thereon at which a golf ball will contact said club face when said club is in the address position with respect to the golf ball, said point being a meet point (M), the position of said meet point (M) being a function of the magnitude of the loft angle ($\theta$) of said head, such that the higher the loft angle ($\theta$), the closer said meet point (M) will be to the lower edge of said club face, the distance (JM) between the meet point (M) on said club face and the lower edge (J) of said club face being given as follows:

$$JM = R \sec\theta(1 - \sin\theta)$$

where

R: radius of standard golf ball, $\theta$: loft angle;

said club head having a mass and having a center of gravity of its mass, said center of gravity being spaced from said club face, said center of gravity, when viewed from a cross section taken in plane perpendicular to the club face, being located on a line substantially perpendicular to said club face through said meet point (M).

2. A golf club according to claim 1, said club head being a wooden club head including a wooden body section, a lower sole portion of said body section and a sole metal section formed of a metal piece fixed to the sole portion of said body section, wherein said sole metal section covers substantially the entire sole portion of said body section, wherein said sole metal section, as viewed from a cross section of said club head taken in a plane perpendicular to said club face, has certain widths along its length which widths are a function of said loft angle such that, the larger the loft angle, the greater are the widths of the sole metal section near the club face in comparison with those remote from the club face, whereby the relationship between the center of gravity and the meet point is maintained.

3. A golf club according to claim 2 wherein, at a certain loft angle, the widths of the sole metal section have a gradual, converging taper in a direction toward said club face.

4. A golf club according to claim 2 wherein, at a particular loft angle, the widths of the sole metal section have a gradual, converging taper in a direction away from said club face.

* * * * *